US009541350B1

(12) United States Patent
Sierchio et al.

(10) Patent No.: US 9,541,350 B1
(45) Date of Patent: Jan. 10, 2017

(54) COORDINATING WAVES OF LONG-RANGE STRIKE WEAPONS (LRSWS) TO ATTACK A TARGET SET BY PASSING OBSERVATIONAL SENSOR DATA FROM LEAD LRSWS TO FOLLOWER LRSWS

(71) Applicant: Raytheon Company, Waltham, MA (US)

(72) Inventors: James G. Sierchio, Tucson, AZ (US); Richard J. Wright, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 14/946,139

(22) Filed: Nov. 19, 2015

(51) Int. Cl.
*G06F 19/00* (2011.01)
*F41G 7/30* (2006.01)

(52) U.S. Cl.
CPC ..... *F41G 7/308* (2013.01); *F41G 7/303* (2013.01)

(58) Field of Classification Search
CPC ..... F41J 5/06; F41J 5/12
USPC ..... 235/400–418
See application file for complete search history.

(56) References Cited

U.S. PATENT DOCUMENTS

| | | | |
|---|---|---|---|
| 6,427,574 | B1 | 8/2002 | Callahan |
| 6,923,404 | B1 | 8/2005 | Liu et al. |
| 7,159,501 | B1 | 1/2007 | Ansay et al. |
| 8,708,285 | B1 | 4/2014 | Carreiro |

OTHER PUBLICATIONS

Raytheon, Tomahawk Cruise Missile, Long-Range, Combat Proven "Weapon of Choice", 2008.
"Weapons: Long-Range Standoff Weapons", Naval Aviation Vision, Jan. 2010.

*Primary Examiner* — Jamara Franklin
(74) *Attorney, Agent, or Firm* — Eric A. Gifford

(57) ABSTRACT

Multiple LRSWs are launched to place at least one follower LRSW in a trailing position to at least one lead LRSW in a lead wave. Knowledge of the target space and particularly the primary target gained by the lead LRSWs is transmitted to the follower LRSWs (either directly or via another communication platform such as a satellite or UAV) and incorporated by the follower LRSWs to inform target selection. The follower LRSWs in the following wave trail the lead LRSWs in the lead wave with sufficient spacing in time and distance to inform target selection and with range remaining to maneuver to the selected target. This knowledge may be transmitted back to another follower LRSW (together with any data acquired the initial follower LRSW) and so forth in a "string" of LRSWs to inform target selection and maneuver the LRSWs to the primary target or an alternate target.

20 Claims, 10 Drawing Sheets

COORDINATING WAVES OF LONG-RANGE STRIKE WEAPONS (LRSWS) TO ATTACK A TARGET SET BY PASSING OBSERVATIONAL SENSOR DATA FROM LEAD LRSWS TO FOLLOWER LRSWS

BACKGROUND OF THE INVENTION

Field of the Invention

This invention relates to the use of long-range strike weapons (LRSWs) to attack a target set, and more particularly to a method of coordinating waves of lead and follower LRSWs to attack the target set.

Description of the Related Art

Long-range strike weapons (LRSWs) are by definition used to attack targets at long distances beyond direct line-of-sight (LOS) communications with fire control. Once beyond direct LOS, communication is maintained through one or more other platforms such as satellites or unmanned aerial vehicles. The LRSW is suitably a subsonic or supersonic jet engine-powered weapon configured to destroy the target with kinetic energy or explosive detonation. Raytheon's Tomahawk cruise missile is a long-range, all-weather, subsonic cruise missile designed to attack a variety of surface or possibly sea-based targets. Other examples of LRSWs include but are not limited to Advanced Cruise Missile (ACM) and Joint Air-to-Surface Standoff Missile-Extended Range (JASSM-ER).

The Tomahawk cruise missile is pre-programmed with the GPS coordinates of a primary target and a flight path to attack the primary target. The flight path is computed as the minimum time path to reach the primary target avoiding known obstacles such as mountains, tall buildings or anti-missile installations. Once in range, the Tomahawk uses its sensor capability to verify the target and to select an aimpoint to strike the target. The sensor capability may include active or passive visibile, IR or radar capability depending on the mission.

Multiple Tomahawk cruise missiles may be launched to attack a single primary target. Typically all of the missiles are fired in a single wave. However, if timeliness is not required due, for example to the nature of the target or the local defenses, fire control may wait for bomb damage assessment (BDA) and launch the additional cruise missiles if needed. In many mission scenarios this option is not available.

An improvement to the Tomahawk was network-centric warfare-capabilities, using data from multiple sensors (aircraft, UAVs, satellites, foot soldiers, tanks, ships) to find its target. The Tomahawk will also be able to send data from its sensors to these platforms. The "Tactical Tomahawk" takes advantage of a loitering feature in the missile's flight path and allows commanders to redirect the missile to an alternative target, if required. The Tomahawk can be reprogrammed in-flight to attack predesignated targets with GPS coordinates stored in its memory or to any other GPS coordinates. Also, the missile can send data about its status back to the commander. The Tactical Tomahawk entered service with the US Navy in 2004.

Another network-centric approach is to launch three long-range strike vehicles to attack a primary target. One vehicle includes sensor capability, one vehicle includes jamming capability and one vehicle is the strike weapon. The sensor vehicle senses the primary target and sends data via a short-range communication link to the jamming and strike vehicles to coordinate the attack.

SUMMARY OF THE INVENTION

The following is a summary of the invention in order to provide a basic understanding of some aspects of the invention. This summary is not intended to identify key or critical elements of the invention or to delineate the scope of the invention. Its sole purpose is to present some concepts of the invention in a simplified form as a prelude to the more detailed description and the defining claims that are presented later.

The present invention provides for a method of tactical engagement of ground or sea-based targets using waves of LRSWs that reduces the number of LRSWs required to attack a target set. This in turn increases the number of threats the LRSW inventory can engage.

This is accomplished by launching multiple LRSWs that place at least one follower LRSW in a trailing position to at least one lead LRSW in a lead wave. Knowledge of the target space and particularly the primary target gained by the lead LRSWs is transmitted to the follower KVs (either directly or via another communication platform such as a satellite or UAV) and incorporated by the follower LRSWs to inform target and aimpoint selection. The follower LRSWs in the following wave trail the lead LRSWs in the lead wave with sufficient spacing in time and distance to inform target selection and with range remaining to maneuver to the selected target. This knowledge may be transmitted back to another follower LRSW (together with any data acquired by the initial follower LRSW) and so forth in a "string" of LRSWs. The last LRSW in the string may transmit the data along a direct LOS to a ground station and fire control. This improves both the efficacy and efficiency with which the primary targets are attacked while allowing follower LRSWs to be re-targeted to alternate targets if not required to destroy the primary targets assigned to the lead wave.

In an embodiment, each follower LRSW is pre-programmed to attack a target corresponding to one of the primary targets. The follower LRSW can confirm selection of that primary target or make a retargeting decision to an alternate target within its remaining range based on the data received from the lead LRSW. The follower LRSW can make further modifications to the targeting decision or aimpoint selection based on its own observational sensor data.

In an embodiment, the lead wave includes a single lead LRSW and the following wave includes a single follower LRSW. The follower LRSW is launched in the trailing relationship to the lead LRSW to attack the primary target, receives and processes observational sensor data and processed mission data from the lead LRSW to inform final selection of either the primary target or an alternate target in the follower target set and receives and processes its own observational sensor data to select an aimpoint on the selected target.

In an embodiment, the lead wave includes multiple N lead LRSWs to attack a plurality of primary targets in a target set and the following wave includes a multiple M LRSWs where $M<N$. The M follower target sets together include all of the primary targets in the lead target set such that each lead LRSW has at least one follower LRSW capable of attacking its primary target. At least one of the follower LRSWs must listen to a plurality of the lead LRSWs with range remaining to attack each of their designated primary targets. Each follower LRSW may be pre-programmed to identify the subset of lead LRSWs the follower LRSW receives data from and their targets. In different embodiments, each follower LRSW may be pre-programmed to listen to a plurality of the lead LRSWs and to relatively weight the data from said plurality of lead LRSWs to inform the follower LRSW's target selection such that the follower LRSWs will not all select the same target. In different embodiments, the follower LRSWs transmit data within the wave to collaboratively inform target selection.

In different embodiments, each of the lead and follower LRSWs are capable of autonomously selecting and attacking a target. Once launched, each LRSW is capable of selecting and attacking a target without further communication and specifically data from the lead LRSW.

In different embodiments, each lead LRSW transmits observational sensor data (e.g., visible, IR, radar, impact) and processed mission data (e.g., health and status of the LRSW, target selected, aimpoint and whether target was hit).

In different embodiments, the LRSWs in the lead and following waves are spaced such that the follower LRSWs receive initial transmission of data prior to the follower LRSWs being within range to acquire the target via their own sensor capability. In an embodiment, the follower LRSWs receive the final transmission of data prior to being within sensor acquisition range. In another embodiment, the follower LRSWs acquire the selected targets prior to the lead LRSWs attack on the target(s) and collect and process real-time observational sensor data of the attack. Once in sensor acquisition range, the follower LRSWs transition to become a lead LRSWs to collect and transmit data.

In different embodiments, the lead LRSWs follow flights paths that deviate from a minimum time flight to the primary target to collect, process and transmit observational sensor data for one or more possible targets or non-targets along the flight path to the primary target.

These and other features and advantages of the invention will be apparent to those skilled in the art from the following detailed description of preferred embodiments, taken together with the accompanying drawings, in which:

DETAILED DESCRIPTION OF THE INVENTION

Figure 1A:
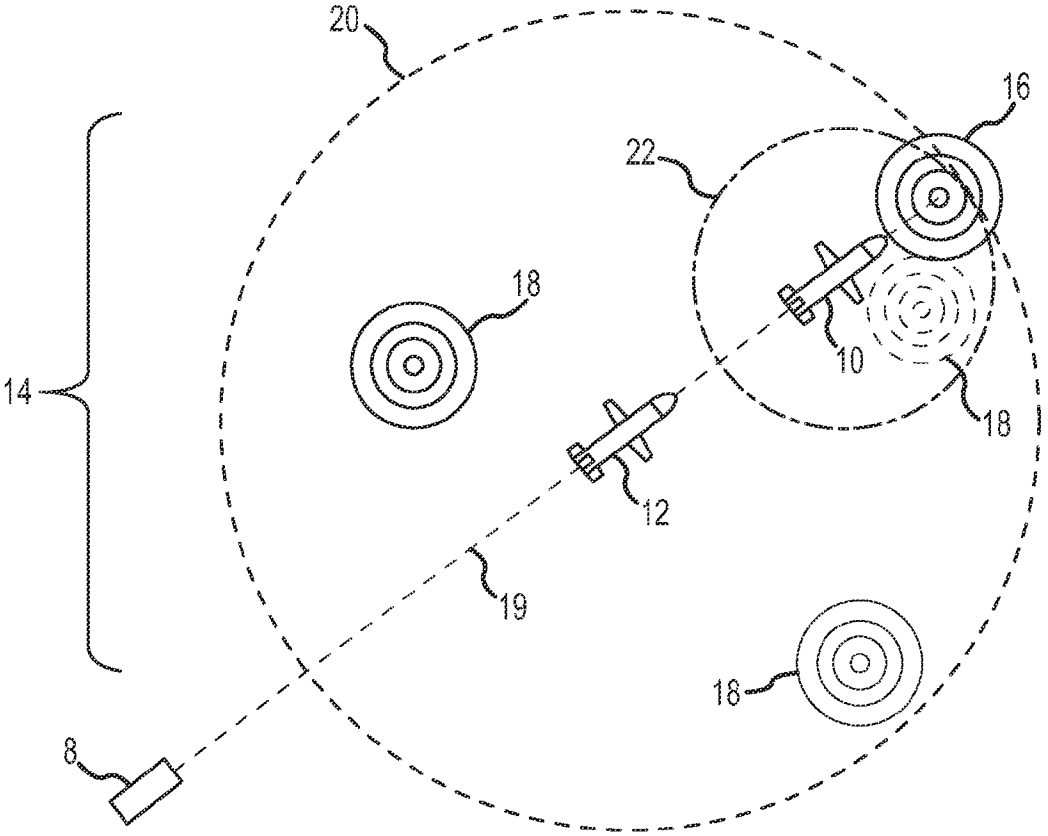
FIGS. 1*a* through 1*c* are diagrams illustrating the remaining range and views of a target set in a leader-follower LRSW string.

The present invention describes a method of tactical engagement of ground or sea-based targets using waves of LRSWs that reduces the total number of LRSWs required to attack a target. Lead and follower LRSWs are launched to place at least one follower LRSW in a trailing position to at least one lead LRSW in a lead wave. Knowledge of the target space and particularly the primary target gained by the lead LRSWs is transmitted to the follower KVs (either directly or via another communication platform such as a satellite or UAV) and incorporated by the follower LRSWs to inform target and aimpoint selection. The follower LRSWs in the following wave trail the lead LRSWs in the lead wave with sufficient spacing in time and distance to inform target selection and with range remaining to maneuver to the selected target. This knowledge may be transmitted back to another follower LRSW wave (together with any data acquired the initial follower LRSW) and so forth in a "string" of LRSWs (wave-to-wave). The last LRSW in the string may transmit the data along a direct LOS to a ground station. This improves both the efficacy and efficiency with which the primary targets are attacked while allowing follower LRSWs to be re-targeted to alternate targets if not required to destroy the primary targets of the lead wave.

In one tactical scenario, a single follower LRSW is launched in a trailing position to a lead LRSW to attack a primary target. The follower LRSW receives and processes observational sensor data and processed mission data from the lead LRSW to inform final selection of either the primary target or an alternate target and receives and processes its own observational sensor data to select an aimpoint on the selected target.

In another tactical scenario, a lead wave of N LRSWs is launched to attack a plurality of primary targets. A following wave of M<N LRSWs is launched in a trailing relationship. Although fewer in number, the follower LRSWs have range remaining (at the time of the attack by the lead LRSWs) to collectively attack any (but not all) of the primary targets.

A target set may include all of the known land or sea-based targets that might be attacked by multiple waves of LRSWs in a lead-follower relationship in a single coordinated attack. The target set for each LRSW in the lead wave, a "lead LRSW", includes at least a primary target and possibly one or more alternate targets in close proximity to the primary target. The target set for each LRSW in the following wave, a "follower LRSW", includes at least one primary target assigned to one of the lead LRSWs and at least one alternate target so that the follower can attack a primary target if needed or divert to attack an alternate target. In general, the target set for a follower LRSW will include more targets than the target set for a lead LRSW owing to the follower's ability to retarget with significantly greater remaining range.

The target set and targets may be identified in various ways. A fixed target may be identified by a fixed set of GPS coordinates. A movable target may be identified by a region defined by GPS coordinates or last known GPS coordinates. A target package may be defined by a list of high value targets. Each target may be assigned a label and provided with distinctive characteristics of the target in order to recognize/differentiate/identify the target and select an aimpoint.

Figure 1B:
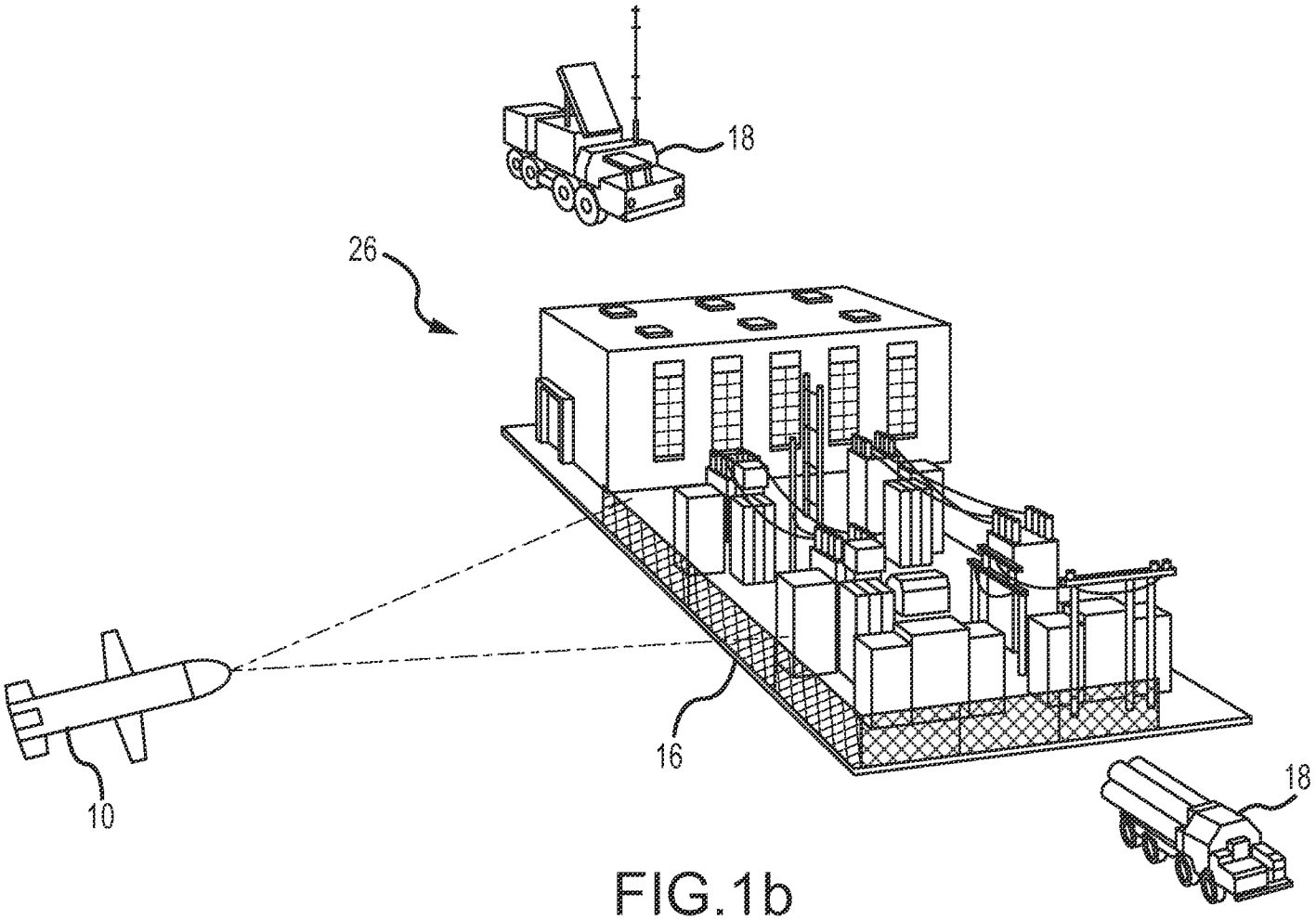
Figure 1C:
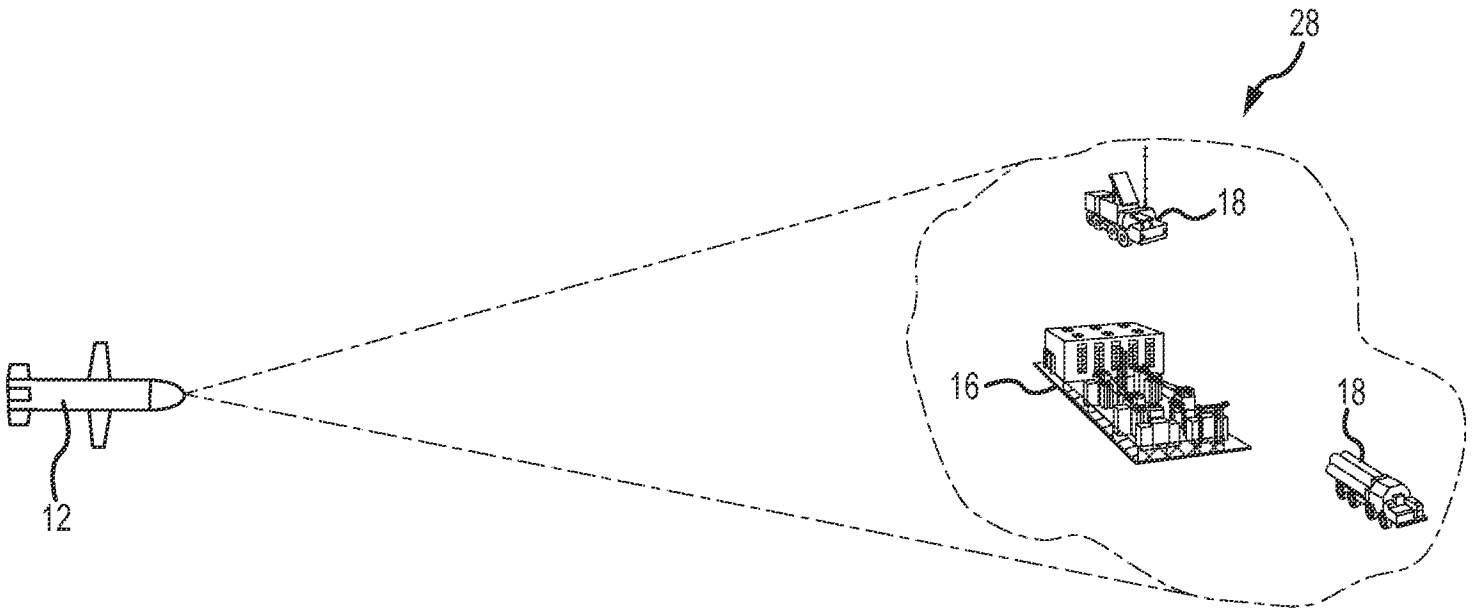

The principle advantages of launching multiple LRSW in different waves from a launch site 8 to form leader and follower LRSWs, 10 and 12 respectively, to cooperatively engage a target set 14 are illustrated in FIGS. 1*a* and 1*b*. Knowledge of the target set 14 gained by the lead LRSW including observational sensor data of its assigned primary target 16, any known alternate targets 18 or other possible targets or non-targets (e.g., hospitals, schools, etc.) in its path 19 is collected, processed and transmitted to the follower KV 12 where it is incorporated to inform the target selection of the follower KV.

Assuming equally capable LRSWs, the remaining range 20 of follower LRSW 12 is substantially larger than the remaining range 22 of lead LRSW 10 due to the remaining propellant/flight time. For example, an additional 30 minutes of propulsion/flight time may correspond to several hundred miles of additional remaining range capability. This allows a follower LRSW to possibly attack the primary target of multiple lead LRSWs depending upon the distance between primary targets or to retargeted to attack a number of alternate targets.

As also shown, the view 26 of the scene from lead LRSW 10 is more highly resolved than the view 28 from follower LRSW 12 due to the relatively close proximity of the lead LRSW 10 to the scene allowing for enhanced gathering of observational sensor data and processed mission data. The lead LRSW 10 can collect and process high-resolution visible, IR or radar imagery to provide data as to target recognition, discrimination and identification and aimpoint selection. The lead LRSW 10 can positively identify the power station as primary target 16 and a fuel truck and a mobile missile battery as known alternate targets 18 whereas follower LRSW 12 is not yet within sensor range and can only detect three possible objects. Lead LRSW 10 can also transmit processed mission data such as its health & status, the final target selection, aimpoint selection and whether the target was hit.

Based on this data, follower LRSW 12 can decide whether it needs to attack the lead's primary target 16 or not. If so, the follower LRSW can use the additional high-resolution data to select an aimpoint for maximum effectiveness. If not, the follower LRSW can use data about the primary target (and other targets and non-targets) to inform selection of an alternate target. Having much greater remaining range, follower LRSW 12 can select and attack an alternate target in the target set. If the lead LRSW 10 determines that its assigned primary target is not a "real" target, it can select another target from the set and attack that target, however its remaining range and thus subset of possible alternate targets is more limited.

Launching waves of LRSWs to cooperatively engage a target set allows each subsequent LRSW to improve the probability of primary target destruction based on information from the previous LRSW's engagement. The follower LRSW gets complete target scene discrimination early, foreknowledge of the lead LRSW behavior and ability to interpret observations to correctly select and engage its own target. This reduces the number of LRSWs required to destroy the primary target, which in turn increases the number of targets the LRSW inventory can engage.

Figure 2:
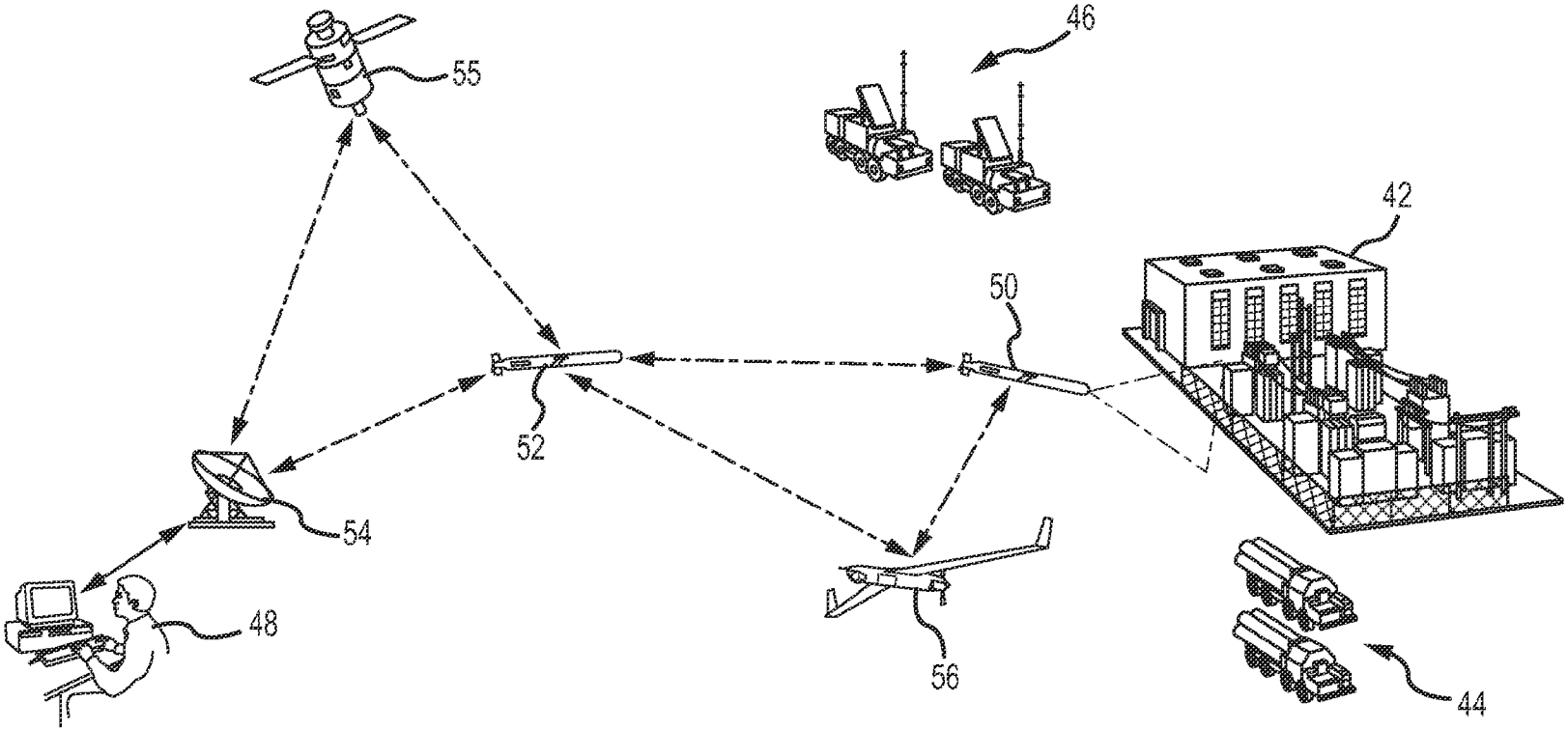
FIG. 2 is diagram of an embodiment of a LRSW launch scenario to form waves of LRSWs in a leader-follower relationship to attack a target set.

Referring now to FIG. 2, in an embodiment a target set includes a power station 42 identified by fixed GPS coordinates and characteristics of a power station, two fuel trucks 44 identified by last known GPS coordinates and characteristics of a fuel truck and a list of high value targets (HVTs) such as mobile missile batteries 46. In this example, the mobile missile batteries are not previously known to be in the target area.

Fire control 48 orders a pair of LRSWs 50 and 52 to be launched and flown along a path in a lead-follower relationship to attack power station 42. Lead LRSW 50's target set includes only the power station 42 as the primary target. Follower LRSW 52's target set includes the power station 42 as the primary target and each of the fuel trucks 44 as alternate targets. The mobile missile batteries 46 are alternate targets in that they are designated HVT.

Lead LRSW 50 is launched and flown along a path to attack power station 42. Follower LRSW 52 is then launched in a trailing position with respect to lead LRSW 50 and flown along a path to attack power station 42. The LRSWs may follow the same or different paths to the primary target. The launch of follower LRSW 52 is timed so that the follower LRSW has, at the time of attack by the lead LRSW 50, sufficient remaining range to attack either the primary target or at least one of its alternate targets.

Once beyond direct LOS with ground station 54, lead LRSW 50 maintains communication with fire control 48 via follower LRSW 52 (and subsequent follower LRSWs) which maintain direct LOS or via a combination of one or more satellites 55 and UAVs 56 in the region. Communication along the "string" of LRSWs is generally preferred as it is less likely to be intercepted or jammed. The lead LRSW can communicate data back to the fire control or receive non-LRSW observational data updates or other data from fire control.

Lead LRSW 50 may initiate collection and processing of observational sensor data before it is within range to acquire the primary target, where "acquisition" is defined as being sufficiently close to provide high-resolution imagery of the selected target that the LRSW's on board automated target recognition (ATR) system can identify the target. This may be done to collect, process and transmit data regarding other targets or non-targets in the target area for offline processing by fire control or online real-time processing by the follower LRSW 52. For example, the lead LRSW 50 might locate and identify the mobile missile batteries 46. Given the high value threat designation of those targets, either or both of the lead or follower LRSWs may retarget themselves to attack the mobile missile batteries. Or fire control may order another lead/follower launch to attack the batteries.

Once in acquisition range of the primary target, the lead LRSW 50 collects and processes images (visible, IR, radar) of the primary target to extract observational sensor data and to determine whether the assigned primary target is present (as opposed to missing, a decoy etc.), make final target selection and attack the target. The lead LRSW 50 transmits the observational sensor data, which can be raw image data, extracted target features and characteristics, classified targets or aimpoint characteristics and transmits processed mission data, which includes health & status of the lead, final target selection, aimpoint selection and whether the target was hit. Whether the target was hit is particularly important information for both fire control and for the follower LRSW to make a final target selection. Whether the target was hit can be determined based on video processing and/or an impact sensor, which data can be transmitted prior to destruction of the lead LRSW. The data is preferably communicated directly to the follower LRSW over the communications link along the string. Alternately, the data could be communicated via an external platform such as the satellite or UAV.

Follower LRSW 52 receives an initial transmission, and typically multiple updated transmissions, of the observational sensor data and processed mission data in real-time well before the follower LRSW is within range to acquire the primary target and prior to the lead LRSW attacking the primary target (or other selected target). Follower LRSW 52 may retransmit the lead data to fire control along with its own health & status and any of its observational sensor data along the path (e.g., the mobile missile batteries).

Follower LRSW 52 continues to receive and process the observational sensor data and processed mission data until it receives a final transmission, which includes the critical piece of data as to whether the lead LRSW successfully attacked the selected target. In the last seconds, the lead LRSW may determine that the target was in fact a decoy or not the primary target, and transmit this critical information as well as features of the actual target. The follower LRSW 52 may or may not have acquired the target when it receives final transmission. If the target has been acquired, the follower LRSW 52 can collect and process its own real-time observational sensor data of the lead LRSW's attack on the target.

Follower LRSW 52 continues to process the data from the lead LRSW and incorporate that data with its own observation sensor data (once available) in view of its own pre-programmed target set and priorities to inform its target selection. This target selection may change as more data becomes available or as the remaining range shrinks. For example, if the lead LRSW 50 determines early on that the primary target has already been previously destroyed, the lead LRSW 50 will retarget itself to attack an alternate target from its target set and the follower LRSW 52 will be released to retarget itself to attack another alternate target from its target set. Otherwise if the lead LRSW 50 selects and attacks the primary target, the follower LRSW 52 will likely wait until it receives confirmation that the primary target was or was not hit before it makes a final target selection. The longer the follower LRSW 52 waits the less its remaining range to attack alternate targets. If the lead LRSW transmits health and status information that indicates the lead is offline, the follower LRSW may make its final target selection of the primary target. Alternately, the follower LRSW 52 may process the new data regarding the existence and location of the HVT mobile missile batteries 46 and immediately attack one of the batteries.

Once within range to acquire targets in its pre-programmed target set, the follower LRSW 52 transitions to become a lead LRSW to collect, process and transmit its observational sensor data and processed mission data to any additional followers or fire control.

In the present tactical engagement, data collected, processed and transmitted by a lead LRSW is used by a follower LRSW to inform target selection to either attack the lead's selected target again or to attack an alternate target. In this scenario, data is passed down the "string" to fire control for offline processing to improve future target selection e.g., to improve models to differentiate actual targets from decoys, to improve aimpoint selection etc. . . . . The data is not collected, processed and transmitted to fire control to allow a commander to re-direct a LRSW to a different target. A commander can utilize the communication link to override the system and re-direct a LRSW, which is outside the scope of the present invention. Unlike "Tactical Tomahawk" the present invention shares data between waves of LRSWs and allows the LRSWs to autonomously process whatever data is available to them to inform target selection without a human in the loop. This constitutes the next advancement in network-centric warfare-capabilities for LRSWs.

Figure 3:
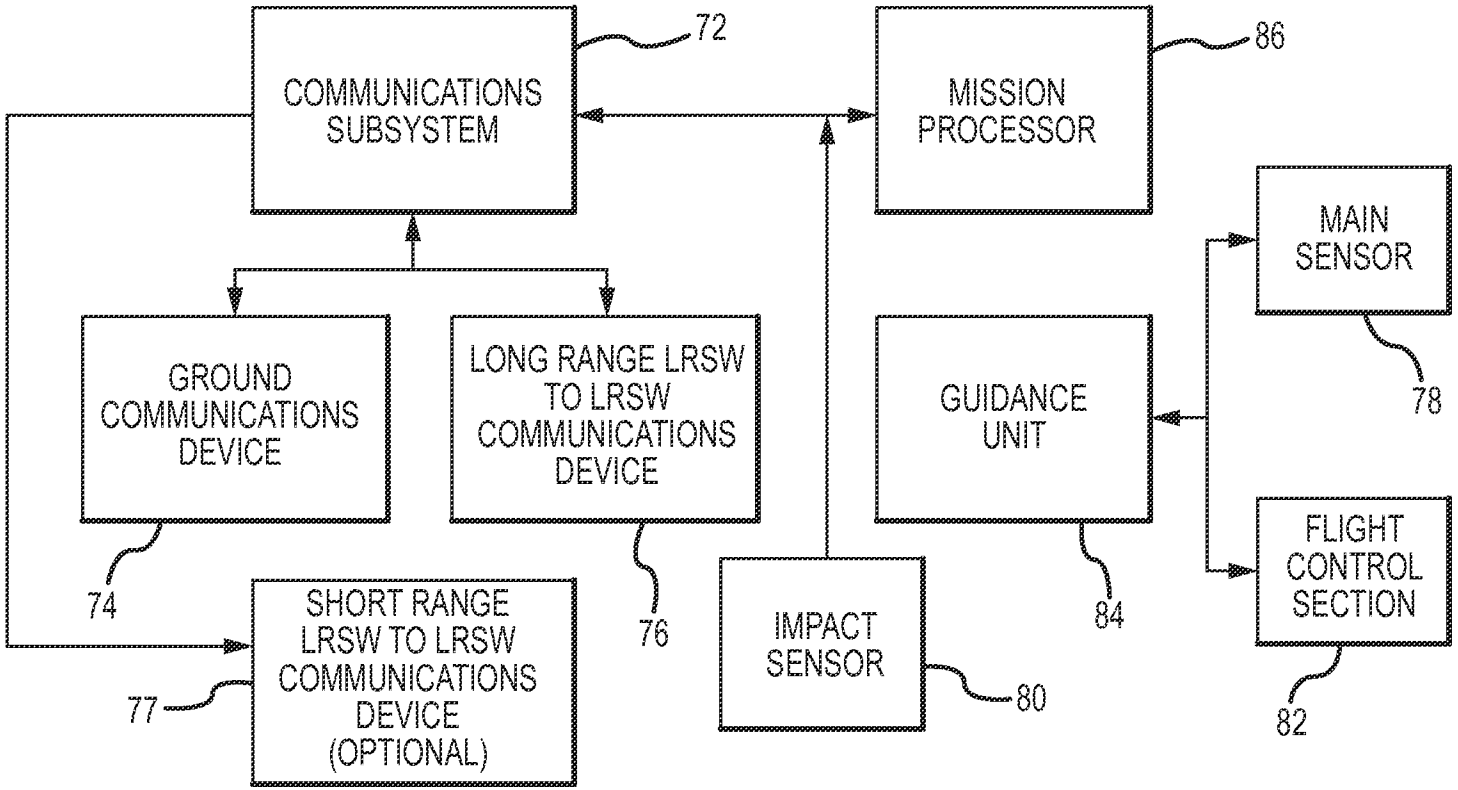
FIG. 3 is a system block diagram of a LRSW.

Referring now to FIG. 3, an autonomous LRSW suitable for use as a lead or follower LRSW may require certain additional capability not present in existing LRSWs e.g. long-range LRSW-to-LRSW communications, short-range LRSW-to-LRSW communications, impact sensor and data integration. This capability may be provided by retrofitting existing LRSW s or by redesigning the LRSW.

The autonomous LRSW includes a communications subsystem 72 including a bi-directional ground communications device 74, a bi-directional long-range LRSW-to-LRSW communications device 76 to communicate with the other KVs in the string, an optional short-range LRSW-to-LRSW communication device 77 an inertial measurement system including an IMU and an optional GPS (provides improved position localization of the KV) to determine the KV's position and orientation, a main sensor 78 (such as a passive one or two color LWIR sensor, visible band sensor, active or passive radar) configured to image a determined target volume of a target scene and provide discrimination to support target selection, an impact sensor 80 configured to sense target impact and transmit impact data, a flight control section 82 to the LRSW to attack the selected target, a mission processor 86 configured to integrated other observational data received from the ground, its own observational sensor data and the observation sensor data received from the lead LRSW to autonomously select a target and aimpoint and determine maneuvers to engage the target and a guidance unit 84 configured to track the position and orientation of the LRSW and to execute maneuvers received from the mission processor.

The ground communications device 74 on existing LRSWs is an "upward tilted" antenna for reception via satellite relay of one-way communications from the ground command center. Once the LRSW has acquired the target, communication via this antenna would require reorienting the LRSW, which is not done. Consequently existing LRSWs cannot send or receive information once the target has been acquired.

An autonomous lead/follower LRSW must have the capability to send and receive information post-acquisition without having to reorient the LRSW. Such post-acquisition communication cannot interfere with prosecution of the target. To this end, a lead/follower LRSW is provided with additional long-range LRSW-to-LRSW communications capability. Communications with a satellite and/or a UAV would require antennas specifically designed and oriented for that purpose, and may leave the LRSW vulnerable to communications interception and/or jamming. This capability may be in addition to and separate from the tilted CLS antenna or integrated in a new communications device that provides both the LRSW-to-ground and LRSW-to-LRSW communications both pre and post-acquisition. Bi-directional communication is preferred, although in some applications one way communications from the lead backward through the string to ground may be acceptable. The LRSW-to-LRSW communications device 76 might include, for example, fixed front and rear facing antennas mounted forward and aft of the KV, a gimbaled antenna or a gimbaled laser. The particular configuration will depend on whether this is a retrofit or new design and other mission factors.

The optional short-range LRSW-to-LRSW communication device 77 for collaborative communications within a wave might include, for example, side facing antennas. This may be used for attack re-routing due to defense system radar discovery by collaborating system and/or for instructing collaborating system to do jamming/decoying, such as with Miniature Air-Launched Decoy (MALD).

The mission processor 86 on existing LRSWs is configured to issue commands to fly the LRSW along the assigned path to the target and to process its own observational sensor data to autonomously select an aimpoint and attack the target. The mission processor 86 is reconfigured to further integrate the observational sensor data and processed mission data received from the lead KV. The observational sensor data and processed mission data is suitably in the exact same format as the data already processed by the LRSW and thus is directly usable by a follower LRSW.

Leader/follower LRSW s have the capability to transmit data post-acquisition and even after impact with a target until the LRSW itself is destroyed. Impact Sensing Capability, when combined with the LRSW-to-LRSW communications, would enable the lead LRSW to send an impact assessment to the follower LRSW, and back to firing control. In the event of an assured target "kill", the follower LRSW would attempt to attack the next highest priority target in its target set, and potentially send that information back to firing control (either because the follower LRSW was not yet in the acquisition phase—this would relate to LRSW launch spacing, or because there were further LRSW s in the string). If the lead LRSW missed the primary target, the follower LRSW would attack it and potentially send that information back to fire control.

The ultimate question for threat negation in a LRSW attack is direct knowledge of what the LRSW hit. While the basic leader/follower concept allows for the best data from conventional observations (e.g., the "last frame" of video) to be passed back to the following LRSW and from there to the engagement command center, impact sensing gives the direct knowledge of what the LRSW hit. The impact sensor must respond very quickly in order to first sense the impact with a desired temporal resolution and to transmit the data to the follower LRSW before the lead LRSW is destroyed. For a kinetic LRSW, the impact sensor may be configured to sense and transmit data about the force of the collision e.g. a type of threshold sensor, or sense and transmit data that can classify the impacted object e.g. the warhead, a counter measure such as a balloon, or debris. For an explosive LRSW, the impact sensor may be configured sense and transmit impact data used for warhead fuzing such as the number of walls and floors penetrated.

For an explosive LRSW, impact sensor 80 might include the standard impact sensor used to detonate the warhead. Or the impact sensor might be the "last frame" of video from the weapon's sensor. The data may be interpreted on-board the lead LRSW and transmitted or the raw data may be transmitted.

For a kinetic LRSW, impact sensor 80 might also include an impact sensor normally only used on an explosive weapon. In this case, it would not be used for fusing but just to sense impact and relay data. Similarly, the impact sensor might be the "last frame" of video.

In some applications, the lead and follower LRSWs may be identical and interchangeable strike weapons. In other applications, the lead and follower LRSWs may have different capabilities e.g. range, communications, sensor and data processing and destructive capabilities. For example, a follower LRSW, if not configurable to transition to a lead LRSW, may have less sensor and communications capabilities but it may have greater range in order to back up a greater number of lead LRSWs and/or greater destructive capabilities to destroy hardened targets. Follower LRSWs may include the short-range communications for collaboratively informing selection of targets based on the data transmitted by the lead LRSWs.

Figure 4:
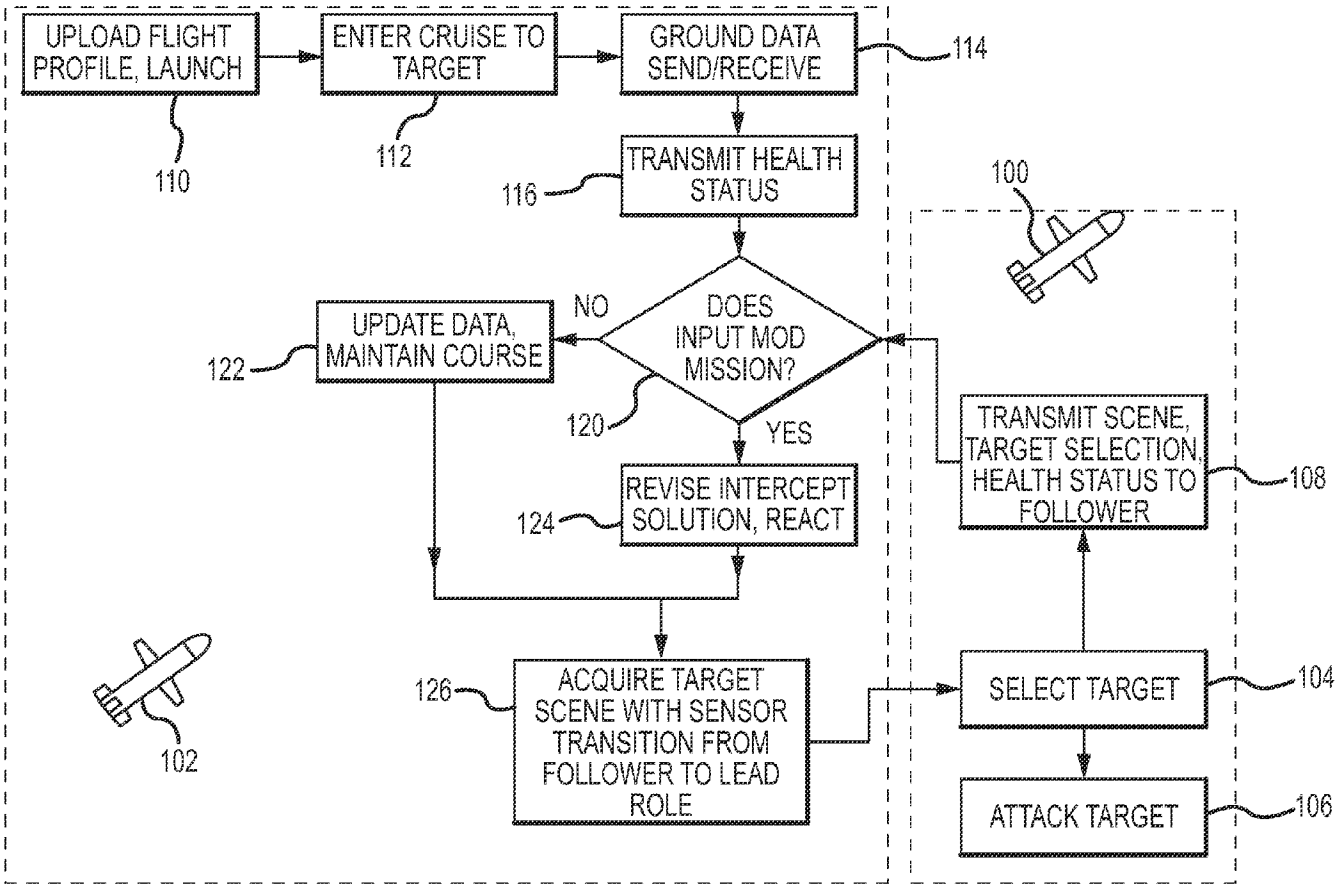
FIG. 4 is a flow diagram of lead-follower LRSW interaction to select and attack targets.

An embodiment of the functions performed by and the interactions between a lead LRSW 100 and a follower LRSW 102 to cooperatively engage a target set is illustrated in FIG. 4. Lead LRSW 100 processes the non-LRSW observational sensor data it received from the ground or a more recent update passed forward from the follower LRSW and its own mission data and observational sensor data to select a target and aimpoint (step 104) and attack the target (step 106). The lead LRSW 100 periodically transmits its observational sensor data and processed mission data from acquisition through impact to the follower LRSW (step 108).

The follower LRSW uploads a flight profile and is launched on a path to the assigned target (step 110). The flight profile may include a list of the one or more lead LRSWs the follower LRSW listens to and a target set including the lead's primary target and one or more alternate targets. Follower LRSW 102 enters a cruise state along the path to attack the primary target (step 112). As the follower LRSW 102 passes over the ground station it conducts a ground data send and receive (step 114) to receive updated non-LRSW observational sensor data and other mission data and to transmit processed mission data and observation sensor data from itself and the lead LRSW and to transmit its health status (step 116). The follower LRSW 102 may also transmit any updated non-LRSW observational sensor data or other mission data forward to lead LRSW 100. As a result, even the lead LRSW 100 has better and more recent data to engage the primary target in the leader/follower scenario.

Follower LRSW 102 integrates the data received from the lead LRSW with its own observational sensor data and non-LRSW sensor data and autonomously decides whether to modify its mission (step 120). If not, the follower LRSW updates the processed mission data and maintains course (step 122). If yes, the follower LRSW revises the intercept solution to the new target and performs a maneuver (step 124). Pre-acquisition the follower LRSW will base its determination on the non-LRSW sensor data received from the ground and the observational sensor data received from the lead LRSW. Post-acquisition the follower LRSW will integrate all sources of data. Upon acquisition, the follower LRSW transitions to the roll of lead KV (step 126). Depending upon the spacing of the lead and follower LRSWs, the follower LRSW may transition before or after the lead LRSW attacks the target.

Figures 5A, 5B, 5C:
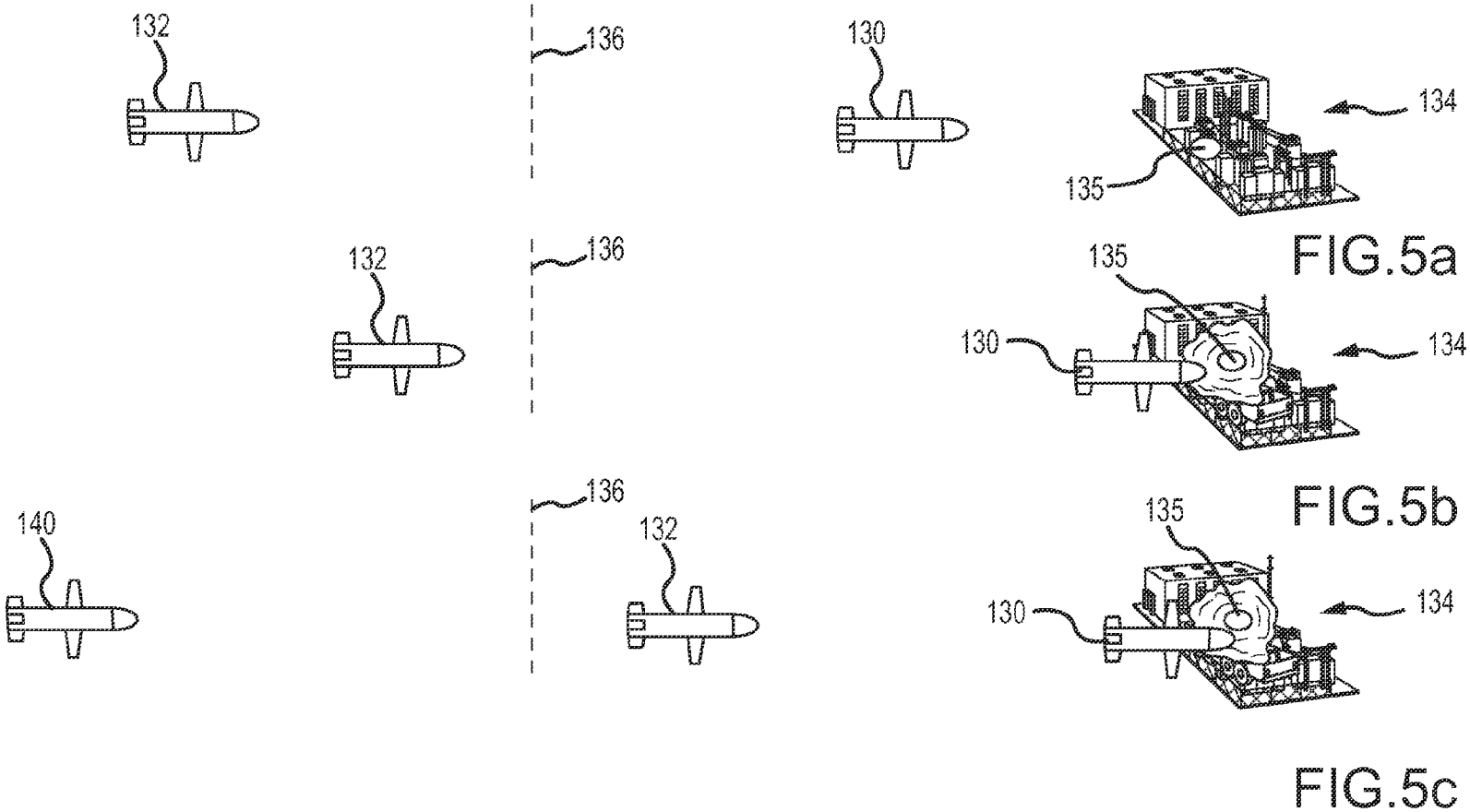
FIGS. 5*a* through 5*c* are diagrams of a string of LRSWs and a primary target at different times during the attack.

FIGS. 5*a*, 5*b* and 5*c* depict different spacing scenarios for a lead LRSW 130, a follower LRSW 132 and any subsequent follower LRSW s to engage a primary target 134.

As shown in FIG. 5*a*, the lead and follower LRSW s are spaced such that the lead LRSW 130 acquires the primary target 134, selects an aimpoint 135 and initiates transmission of its observational sensor data and processed mission data before follower LRSW 132 is within range 136 to acquire the target. The follower LRSW selects the target and maneuvers based on these initial transmissions. By making its initial maneuver pre-acquisition, the follower LRSW can conserve fuel for terminal maneuvers.

As shown in FIG. 5*b*, lead LRSW 130 has impacted primary target 134 at aimpoint 135 and sent a final transmission before follower LRSW 132 is within range 136 to acquire the target. The follower LRSW may be able to detect a bright flash indicative of a successful impact with a warhead. The LRSW s may be spaced to the limits of the communications link to maximize the benefits of an early maneuver and maximize the remaining range of the follower LRSW to attack other targets.

As shown in FIG. 5*c*, follower LRSW 132 has moved within range 136 and acquired the primary target 134 by the time lead LRSW 130 impacts primary target 134 and sends its final transmission. The follower LRSW can see the impact of lead LRSW with the target to gather additional information relevant to informing target selection and transitions to the roll as the lead LRSW. A second follower LRSW 140 has been launched and is now in position to receive transmissions from the new lead LRSW.

Figure 6:
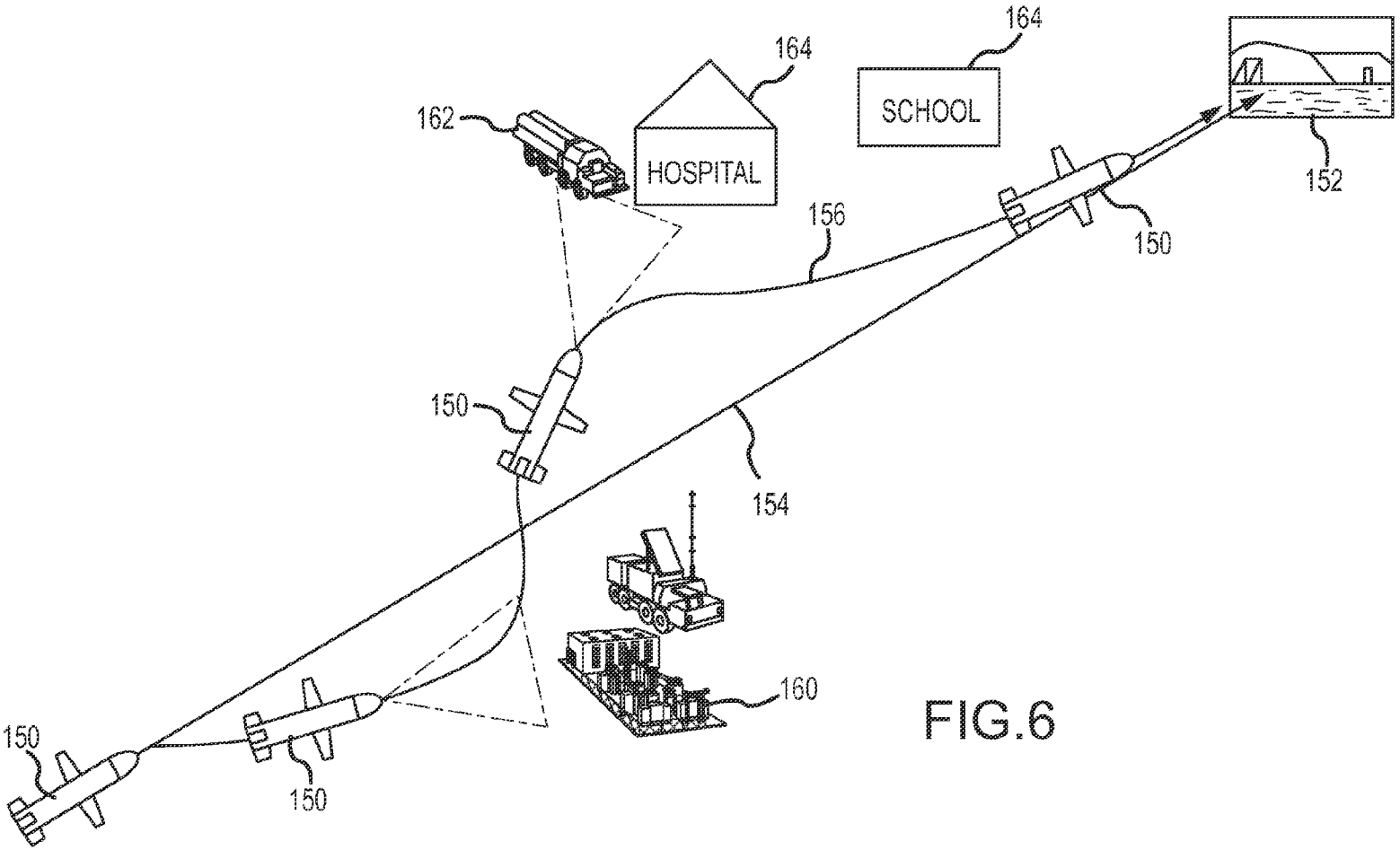
FIG. 6 is an illustration of a lead LRSW flying a path that deviates from the minimum time path to the primary target to gather observational sensor data on targets and non-targets.

As shown in FIG. 6, a lead LRSW 150 can be used to gather observational sensor data of known alternate targets 160, possible targets 162 and non-targets 164 such as schools and hospitals as the LRSW cruises along the path to a primary target 152. Typically, the path is calculated as the "minimum time path" 154 to attack primary target 152. Note, the minimum time path is not necessarily, or even typically, a straight line from launch to the primary target. The minimum time path must consider obstacles such as mountains and tall buildings, no fly zones as well as enemy missile batteries. A path 156 may be computed that considers these obstacles while sacrificing the "minimum time" constraint in order to gather observational sensor data on targets and non-targets outside the minimum time path 154 or at closer proximity, higher-resolution than would be afforded along the minimum time path. Path 156 may be pre-programmed based on knowledge of possible targets and non-targets in the area or adjusted in real-time as the LRSW collects and processes its observational sensor data. The path 156 may be configure to both bring the LRSW in close proximity to the object and to select an angle-of-attack to provide the best view of an object.

In another embodiment, the lead wave includes multiple N lead LRSWs to attack a plurality of primary targets in a target set, each target having one or more unique aimpoints, and the following wave includes a multiple M LRSWs where M<=N. The M follower target sets together include all of the primary targets in the lead target set such that each lead LRSW has at least one follower LRSW capable of attacking its primary target. The followers may be assigned 1:1 such that each follower backs up a single designated lead. Alternately, the followers may, for example, be assigned 1:2 such that each follower backs up a pair of leads or more generally 1:L. In some cases, the pairings are non-overlapping such that each lead has a single designated follower. In other cases, the pairings are overlapping such that each lead has multiple designated followers for greater redundancy and targeting flexibility. The assignments are, in part, determined by the distance between primary targets and the remaining range of the follower LRSW at the time of attack by the lead wave. Each follower LRSW is pre-programmed to identify the subset of lead LRSWs the follower LRSW listens to and their targets. If M<N, at least one of the follower LRSWs must listen to a plurality of the lead LRSWs with range remaining to attack each of their designated primary targets.

Each follower is initially assigned one of the lead's primary targets as its primary target in the follower's target set. If communications should fail, the autonomous follower will engage the primary target and make final targeting decisions and aimpoint selection based solely on its observational sensor data. Accordingly, each follower will follow a flight path that puts the follower in position at the time of the lead attack on the primary target with range remaining to also attack the primary target. The flower might follow the same flight path as the lead. If the follower has been assigned multiple leads it might follow a flight path that positions it between the multiple primary targets so that it has remaining range to attack any one of those primary targets as needed.

In different embodiments, each follower LRSW may be pre-programmed to listen to overlapping pluralities of the lead LRSWs and to relatively weight the data from the plurality of lead LRSWs to inform the follower LRSW's target selection such that the follower LRSWs will not all select the same target. Follower LRSW target selection can be deconflicted (avoid picking same target) either by the pre-programmed target sets and specified leads or by weighting the data from the leads differently for each follower or a combination thereof.

In different embodiments, the follower LRSWs are provided with short-range LRSW-to-LRSW communication capability to transmit data within the wave to collaboratively inform target selection.

Figure 7A:
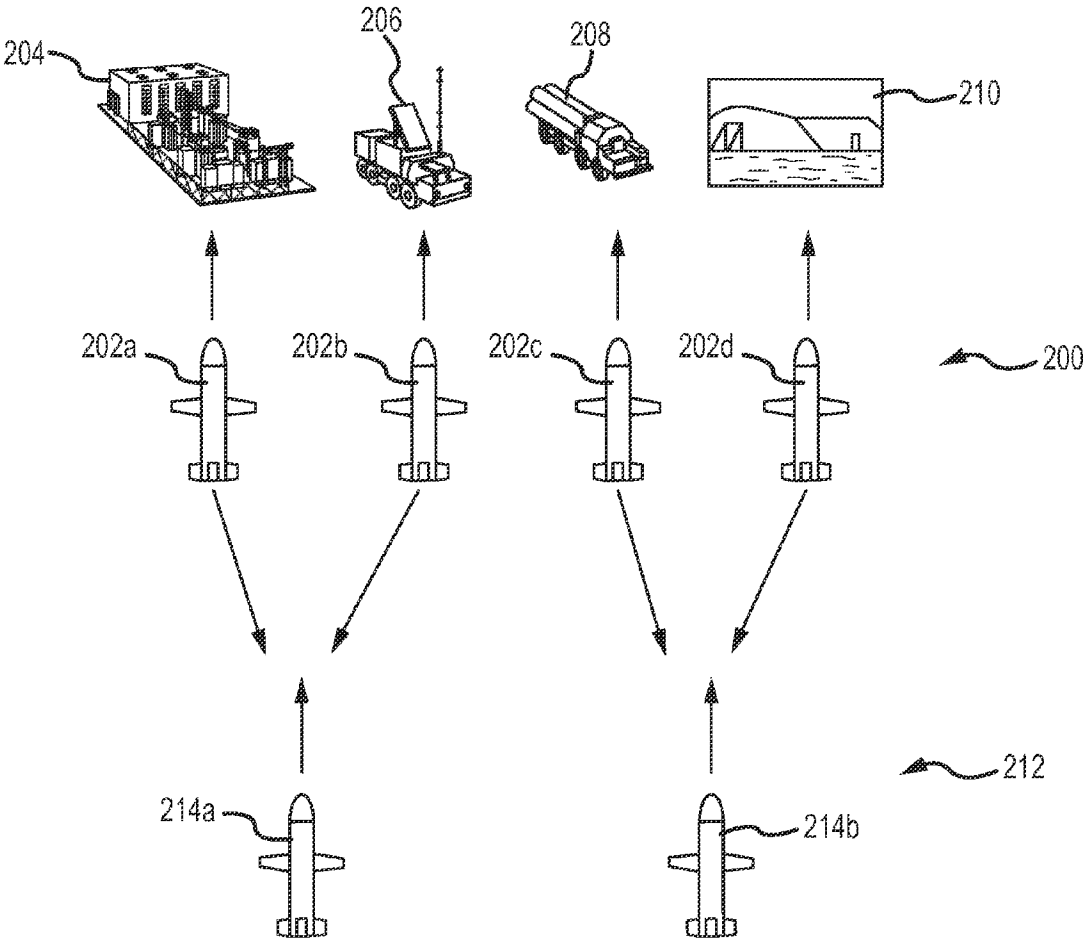
FIGS. 7*a* and 7*b* is a diagram of a first wave of lead LRSWs launched to attack different primary targets and a second wave including a lesser number of follower LRSWs capable of attacking undestroyed primary targets.
Figure 7B:
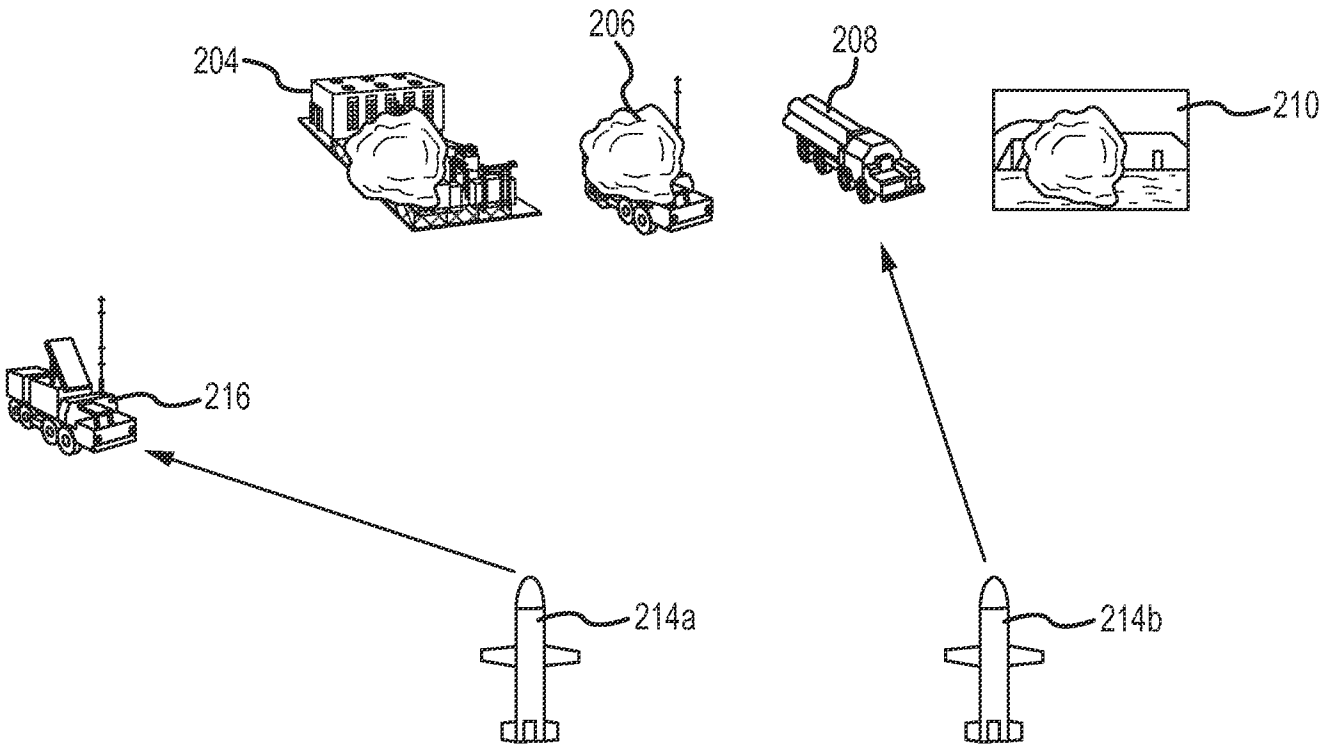

Referring now to FIGS. 7*a* and 7*b*, in an embodiment of a tactical launch a lead wave 200 of four lead LRSWs 202*a*, 202*b*, 202*c* and 202*d* is launched against a target set including a power station 204, a mobile missile battery 206, a fuel truck 208 and a bunker 210. Each lead LRSW has a target set that includes a different one of these targets as its designated primary target. A following wave 212 of two follower LRSWs 214*a* and 214*b* is launched in a trailing relationship to lead wave 200. The following wave is spaced in time and distance such that at the time of attack of the lead wave of the primary targets the follower LRSWs have remaining range to attack any one (but not all) of the primary targets.

In this embodiment, one follower LRSW is allocated for every two lead LRSWs. Follower LRSW 214*a*'s target set includes power station 204 and mobile missile battery 206. Follower LRSW 214*a* is programmed to listen to only lead LRSWs 202*a* and 202*b*. Follower LRSW 214*b*'s target set includes fuel truck 206 and bunker 208. Follower LRSW 214*b* is programmed to listen to only lead LRSWs 202*c* and 202*d*. The follower target sets may also include one or more other alternate targets.

As shown, in the lead wave lead LRSWs 202*a*, 202*b* and 202*d* successfully attack and destroy their assigned primary targets but lead LRSW 202*c* fails to destroy fuel truck 208. Accordingly, follower LRSW 214*b* receives data from lead LRSW 202*c* confirming the failure and independently confirms such failure with its own observational sensor data. Follower LRSW 214*b* finalizes selection of fuel truck 208 and proceeds to attack. By comparison, follower LRSW 214*a* receives data from both its lead LRSWs that both primary targets have been destroyed, which it independently confirms with its own observational sensor data. Follower LRSW 214*a* selects an alternate target in the form of a mobile missile battery 216 from its target set within its remaining range and maneuvers to attack the target.

This simple example illustrates both efficacy and the efficiency of engaging a target set using waves of autonomous LRSWs in which data from the leads is passed back to the followers. First, a follower LRSW in the target area was able to receive, process and act on the data that a primary target was missed autonomously and in real-time to attack and eliminate the primary target. Second, a follower LRSW in the target area that was not needed to eliminate the primary targets was able to select and attack an alternate target. The mission of eliminating four primary targets was accomplished with six LRSWs instead of a more typical eight LRSWs and an alternate target was attacked and destroyed.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. A method of coordinating Long-Range Strike Weapons (LRSWs) to attack one or more targets, comprising:

launching a lead LRSW to attack a primary target in a lead target set;

launching a follower LRSW in a trailing relationship to the lead LRSW;

from the lead LRSW, collecting and processing observational sensor data of a target scene to attack either the primary target or an alternate target from the first target set and transmitting the observational sensor data and processed mission data via a communication link;

from the follower LRSW, receiving and processing the observational sensor data and processed mission data from the lead LRSW via a communications link to inform selection of a target from a follower target set including the primary target and at least one alternate target; and timing the launch of the follower LRSW such that the follower LRSW receives and processes the observational sensor data to inform selection of the target with range remaining to attack either the primary target or the at least one alternate target.

2. The method of claim 1, wherein each of said lead LRSW and said follower LRSW are capable of autonomously attacking the selected target.

3. The method of claim 1, wherein the lead LRSW transmits the observational sensor data and processed mission data directly to the follower LRSW.

4. The method of claim 3, wherein the follower LRSW retransmits the observational sensor data and processed mission data along a direct line of sight to a ground station.

5. The method of claim 1, wherein the follower LRSW is launched in the trailing relationship to the lead LRSW to attack the primary target, receives and processes the observational sensor data and processed mission data from the lead LRSW to inform final selection of either the primary target or an alternate target in the follower target set and receives and processes its own observational sensor data to select an aimpoint on the selected target.

6. The method of claim 1, wherein said lead LRSW comprises an impact sensor, said observational sensor data comprises impact data of the lead LRSW impacting the target.

7. The method of claim 1, wherein the follower LRSW collects and process observational sensor data, wherein the follower LRSW receives an initial transmission of observational sensor data and processed mission data prior to the follower LRSW being within range to acquire the target selected by the lead LRSW.

8. The method of claim 7, wherein the follower LRSW receive a final transmission of observational sensor data and processed mission data prior to the follower LRSW being within range to acquire the target selected by the lead LRSW.

9. The method of claim 7, wherein the follower LRSW acquires the selected target prior to the lead LRSW's attack on that target and collects and processes real-time observational sensor data of the lead LRSW's attack on the target.

10. The method of claim 1, wherein the follower LRSW collects and processes observational sensor data and transitions to become a lead LRSW once in range to acquire targets in the second target set.

11. The method of claim 1, further comprising:

determining a flight path for the lead LRSW that deviates from a minimum time flight to the primary target to collect, process and transmit observational sensor data for one or more possible targets or non-targets along the flight path.

12. A method of coordinating Long-Range Strike Weapons (LRSWs) to attack one or more targets, comprising:

launching a first wave of multiple N lead LRSWs to attack one or more primary targets in a lead target set;

launching a second wave of multiple M follower LRSW in a trailing relationship to the first wave where M<=N;

from each of the lead LRSWs in the first wave, collecting and processing observational sensor data of a target scene to attack either one of the one or more primary targets or an alternate target from the lead target set and transmitting the observational sensor data and processed mission data via a communication link;

from each of the follower LRSWs, receiving and processing the observational sensor data and processed mission data from at least one of the lead LRSWs in the first wave via a communications link to inform selection of a target from a follower target set including at least one of the one or more primary targets and at least one alternate target; and timing the launch of the second wave of follower LRSWs such that the follower LRSWs receives and processes the observational sensor data to inform selection of the target with range remaining to attack either the at least one primary target or the at least one alternate target in the follower target set.

13. The method of claim 12, wherein M<N.

14. The method of claim 13, wherein the lead target set includes a plurality of primary targets, wherein the M follower target sets together include all of the primary targets in the lead target set, wherein at least one of the follower LRSWs receives and processes observational sensor data and processed mission data from a plurality of the lead LRSWs with range remaining to attack the plurality of primary targets in it's follower target set.

15. The method of claim 14, further comprising preprogramming each follower LRSW to identify the subset of one or more lead LRSW the follower LRSW receives data from and their targets.

16. The method of claim 14, further comprising preprogramming each follower LRSW to listen to a plurality of the lead LRSWs and to relatively weight the data from said plurality of lead LRSWs to inform the follower LRSW's target selection.

17. The method of claim 14, further comprising transmitting data among the follower LRSWs in the second wave to inform target selection of each follower LRSW.

18. The method of claim 14, wherein the follower LRSWs receive observational sensor data and processed mission data directly from one or more lead LRSWs.

19. The method of claim 14, wherein each said follower LRSW is launched in the trailing relationship to the first wave of lead LRSWs to attack one of the primary targets, receives and processes the observational sensor data and processed mission data from the one or more lead LRSWs to inform final selection of either the primary target or an alternate target in its own follower target set and receives and processes its own observational sensor data to select an aimpoint on the selected target.

20. The method of claim 14, further comprising:

determining a flight path for each said lead LRSW that deviates from a minimum time flight to its primary target to collect, process and transmit observational sensor data for one or more possible targets or non-targets along the flight path.

* * * * *